US010513860B2

(12) United States Patent
Gillet et al.

(10) Patent No.: US 10,513,860 B2
(45) Date of Patent: Dec. 24, 2019

(54) REVERSIBLE LOCKING-WIRE PLIERS

(71) Applicant: GILLET GROUP, Nogent (FR)

(72) Inventors: Pascal Gillet, Nogent (FR); Fabrice Petit, Orcevaux (FR)

(73) Assignee: GILLET GROUP, Nogent (FR)

( * ) Notice: Subject to any disclaimer, the term of this patent is extended or adjusted under 35 U.S.C. 154(b) by 606 days.

(21) Appl. No.: 14/899,809

(22) PCT Filed: Jun. 20, 2014

(86) PCT No.: PCT/FR2014/051535
§ 371 (c)(1),
(2) Date: Dec. 18, 2015

(87) PCT Pub. No.: WO2014/202913
PCT Pub. Date: Dec. 24, 2014

(65) Prior Publication Data

US 2016/0153206 A1 Jun. 2, 2016

(30) Foreign Application Priority Data

Jun. 21, 2013 (FR) ..... 13 55901

(51) Int. Cl.
*E04G 21/12* (2006.01)
*B21F 15/04* (2006.01)
*B65B 13/28* (2006.01)

(52) U.S. Cl.
CPC ..... *E04G 21/123* (2013.01); *B21F 15/04* (2013.01); *B65B 13/285* (2013.01)

(58) Field of Classification Search
CPC ..... B21F 15/04; B65B 13/285; B65B 13/28; H01R 43/033; H01R 43/042; B25B 3/00;
(Continued)

(56) References Cited

U.S. PATENT DOCUMENTS 2,737,983 A * 3/1956 Pray ..... B21F 15/04 140/118
3,092,152 A * 6/1963 Neff ..... B21F 15/04 140/119

(Continued)

FOREIGN PATENT DOCUMENTS

BE 563 704 A 1/1958

OTHER PUBLICATIONS

International Search Report dated Oct. 6, 2014 from corresponding International Patent Application No. PCT/FR2014/051535; 2 pgs.

*Primary Examiner* — Teresa M Ekiert
(74) *Attorney, Agent, or Firm* — Maier & Maier, PLLC

(57) ABSTRACT

The wire twisting pliers include a reversible transformation device including a casing, a double helix pin, separate right-hand and left-hand guiding elements, housed in a single drum and radially movable between a drive position in which one is directly and forcefully engaged in said right-hand or left-hand helix and couples said casing to said drum, the other is free to retract from said right-hand or left-hand helix, said casing being movable between right- and left-hand positions in which said right-hand and left-hand guiding elements are respectively in the drive position of same, free or vice versa. A reversible wire twisting pliers including such a transformation device.

31 Claims, 8 Drawing Sheets

(58) Field of Classification Search
CPC .... B25B 7/00; B25B 7/20; B25B 7/22; B25B 7/12; B25B 13/14; B25B 7/14; B25B 7/16
See application file for complete search history.

(56) References Cited

U.S. PATENT DOCUMENTS

| | | | | | |
|---|---|---|---|---|---|
| 4,665,953 | A * | 5/1987 | Randall | B21F 15/04 | 140/118 |
| 4,842,025 | A * | 6/1989 | Box | B21F 7/00 | 140/119 |
| 5,004,020 | A * | 4/1991 | Meinershagen | B21F 15/04 | 140/93.6 |
| 5,211,209 | A * | 5/1993 | Geibel | B21F 15/04 | 140/118 |
| 5,560,402 | A | 10/1996 | Bates | | |
| 9,138,800 | B2 * | 9/2015 | Harrison | B21F 15/04 | |
| 9,498,816 | B2 * | 11/2016 | Legg | B21F 15/04 | |

* cited by examiner

Fig. 7A
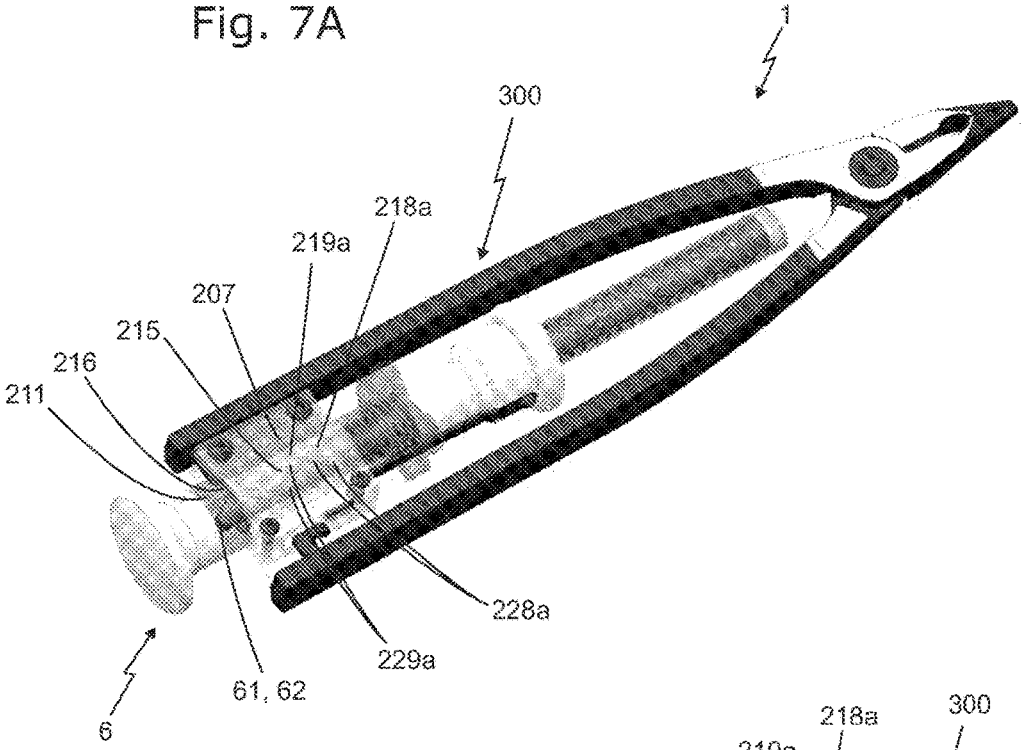
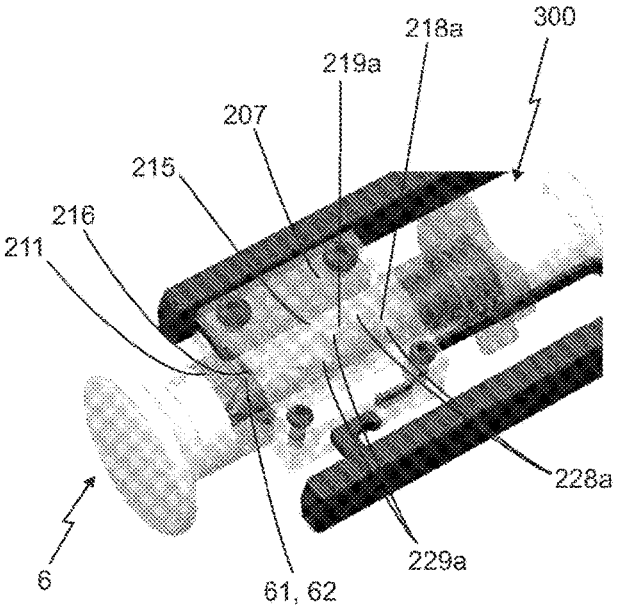
Fig. 7B

REVERSIBLE LOCKING-WIRE PLIERS

TECHNICAL FIELD

This invention relates to reversible locking-wire pliers comprising a reversible movement transformation device making it possible to transform a translation/rotation movement into a rotation/translation movement successively in a first direction then in a second direction.

PRIOR ART

Reversible locking-wire pliers (or twist pliers) are tools commonly used to seal certain pieces of equipment after they are verified and/or adjusted and as such bear witness to the integrity of the equipment and of its adjusting. The equipment to be sealed is for example an engine protected by a casing formed by two shells. In order to seal this motor, one or several eyelets provided across from one another and able to receive the passage of one or of several metal wires are provided in the shells. The free ends of the metal wires are twisted using locking-wire pliers. This twisting is then sealed by means of a seal. As such, any operation of opening the casing can be detected visually by the degradation of the twist and/or of the seal.

Locking-wire pliers are also used more widely to seal electrical meters and/or any sensitive equipment.

Locking-wire pliers can also be used to block in rotation screwing elements, for example screws and/or nuts, and prevent the untimely unclamping of these clamping elements. Blocking screwed elements is particularly useful when the elements screwed are subjected to repeated vibrations, which is in particular the case in the aeronautics field, or more widely in the field of transports. In these fields for which safety is a priority, the good resistance of the elements screwed is essential in order to prevent human and material catastrophes.

Locking-wire pliers can also be used in the field of construction in order to maintain in position framework, for example metal rods, before casting them in concrete. Locking-wire pliers can finally be used in the field of orthopaedics for example to connect bones together by means of suitable links.

Locking-wire pliers are commonly provided with a pinching device making it possible to provide the gripping of the metal wires to be twisted, for example by means of jaws connected to handles. Locking-wire pliers also comprise a movement transformation device able to transform the translation of a pin into rotation of the jaws and as such obtain the twisting of the metal wires.

In order to carry out the twisting, the wires are blocked between the jaws by means of handles. The locking-wire pliers are then held by the end of the pin which is drawn towards the rear, with respect to the jaws, between its starting position and a rear position. The translation towards the rear of the pin causes the rotation of the jaws and therefore the twisting of the metal wires. Locking-wire pliers are commonly provided with a return spring which makes it possible to return the pin, from its rear position to its starting position, and proceed or not with one or several additional twistings.

Simple locking-wire pliers exist, such as those described hereinabove, and reversible locking-wire pliers comprising a reversible movement transformation device making it possible to twist the metal wires successively in a first direction then in a second direction.

Such reversible locking-wire pliers are described in publication U.S. Pat. No. 4,665,953. The reversible movement transformation device of this reversible locking-wire pliers comprises in particular a pin provided with two helixes of the same pitch, provided in opposite directions with respect to one another, namely a left-hand helix and a right-hand helix. The right-hand helix of this pin is coupled to a right-hand nut and the left-hand helix is coupled to a left-hand nut. These right-hand and left-hand nuts are housed in a drum and comprise, each, a shoulder provided on its periphery with longitudinal engagement grooves. The drum comprises a lateral opening provided with notches, able to receive the lateral wings of a first and of a second blocking plate, provided respectively across from engagement grooves of one of the right-hand or left-hand nuts. Each blocking plate is able to pivot in its notch between:

- a free position wherein it is substantially parallel to the longitudinal axis of the drum and authorises the rotation of the right-hand or left-hand nut, and
- a drive position wherein it is inclined with respect to the longitudinal axis of the drum, one of its longitudinal ends being housed in one of the engagement grooves of the right-hand or corresponding left-hand nut in order to block the rotation of the right-hand or left-hand nut in relation to the drum.

The drum comprises an actuator, movable in longitudinal translation in the lateral opening, coupled to a spring blade in the shape of an inverted U, urging successively the inclination of the first and second plates between a first configuration wherein the first plate is in its free position and the second plate is in its drive position, and a second configuration wherein the first plate is in its drive position and the second plate is in its free position. This locking-wire pliers comprise moreover means of automatic locking for blocking the handles in their closed position. These reversible locking-wire pliers are not very practical to use. Indeed, the inverting of the direction of rotation is obtained via a translation, this gesture is not very practical to carry out and often requiring the use of both hands. In addition during the use of the reversible locking-wire pliers, the automatic locking of the handles is not always desirable and can hinder the use of these reversible locking-wire pliers.

Another example is given in publication U.S. Pat. No. 5,211,209 which describes reversible locking-wire pliers substantially similar to the preceding. It is different in particular in that the reversible movement transformation device comprises visual marks provided under the actuator and which as such makes it possible to view the longitudinal position of the actuator and therefore the direction of rotation wherein the reversible locking-wire pliers is ready to rotate. These reversible locking-wire pliers comprise, furthermore, an elastic element urging the handles towards their open position, and a locking device blocking the handles in closed position. This locking device comprises a hook, integral with a first handle and circulating, in a housing provided in a case coupled to the second handle, between a locked position wherein it maintains the hook blocked in the housing, and an unlocked position wherein it authorises the exiting of the hook from the housing. The latch is urged, from its locked position to its unlocked position, by a spring. In order to block the hook in the housing, and therefore the handles in their closed position, the user forces the displacement of the latch towards the hook by compressing the spring. The effort of opening of the handles applied by the elastic element urging them in the opposite direction is such that it prevents the releasing of the hook, itself urged by the spring. The handles are therefore in closed position and locked. In order to unlock the handles, the user tightens them slightly towards one another which causes the release of the spring, the displacement of the latch and the release of the hook. The locking and unlocking of the handles of these reversible locking-wire pliers are therefore controlled by the user.

The change in the direction of rotation of the reversible locking-wire pliers described in the two preceding publications is controlled by the longitudinal displacement of an actuator. A major disadvantage of this type of reversible locking-wire pliers results from the fact that this displacement can be controlled inadvertently by the user, which makes the use of the reversible locking-wire pliers not very reliable.

The reversible locking-wire pliers described in publication U.S. Pat. No. 5,560,402 comprises a reversible movement transformation device of which the direction of rotation is controlled by an angular displacement of a drum.

Other publications such as U.S. Pat. No. 4,842,025 describe alternative embodiments, comprising in particular a pin of which the pitch of the helix is variable over the length of the pin.

Reversible locking-wire pliers known are often impractical to use and generally of a construction, assembly and operation that are complicated which makes them fragile and limits their service life.

DISCLOSURE OF THE INVENTION

This invention aims to overcome these disadvantages by proposing reversible locking-wire pliers comprising a reversible movement transformation device, having an improved robustness allowing it to resist difficult conditions of use in a dusty environment and intensive use while still remaining reliable over time. The reversible locking-wire pliers according to the invention are in addition compact, simple to use and manipulate with a single hand in order to provide the twisting in a first direction, the change in direction then the twisting in a second direction.

In the rest of the description the term "longitudinal" is used to qualify any element and/or plane and/or direction substantially parallel to the axis of the pin, the term "transversal" is used to qualify any element and/or plane and/or direction substantially perpendicular to the axis of the pin and the term "radial" is used to qualify any element and/or direction oriented towards the longitudinal axis, this element and/or this direction able to be included in a transversal plane and/or in an inclined plane with respect to the longitudinal axis and/or on a cone of revolution centred on the longitudinal axis.

Moreover, the terms "proximal" and "distal" are used in reference to locking-wire pliers provided with a transformation device according to the invention and comprising a pin of which one end is able to be manipulated in order to generate this transformation of movements. The term "proximal" is as such used to qualify any element situated towards and/or any direction, oriented towards the end of the pin able to be manipulated by the user in order to provoke the transformation of movements and therefore close to the hand used for the gripping of the pin. The term "distal" is used for any element situated towards and/or any direction oriented towards the opposite direction. The terms "proximal" and "distal" are to be transposed for any other movement transformation device.

The invention relates to reversible locking-wire pliers comprising a pinching device provided with clamping jaws movable between an open position and a closed position wherein they are forced towards one another, a reversible movement transformation device comprising at least one casing and a pin that has an longitudinal axis C of revolution and being movable in translation with respect to said pinching device, said pinching device being coupled by means of anchoring, at least in closed position, to said transformation device so that the translation of said pin is transformed, by said transformation device, into rotation of said pinching device, said pin being provided with at least one right-hand helix and with a recessed left-hand helix and of similar pitches, said casing and said pin being carried out by means of coupling comprising at least one separate right-hand guiding element and one left-hand guiding element, each one radially movable between a drive position wherein said casing is coupled forcefully respectively to said right-hand, left-hand helix, and a free position wherein said casing is free with respect to said right-hand, left-hand helix, said casing being movable with respect to said right-hand, left-hand guiding elements in order to allow for the inversion of the direction of the transformation of movements, between:

- a right-hand position wherein said right-hand guiding element is forced in its drive position and said left-hand guiding element is in its free position, and
- a left-hand position wherein said right-hand guiding element is in its free position and said left-hand guiding element is forced in its drive position.

Said locking-wire pliers are remarkable in that said means of coupling comprise a single drum, concentric with said pin, arranged between said casing and said pin, passes through radially by at least one guiding orifice able to constantly receive at least one first portion of said right-hand, left-hand guiding elements, said right-hand, left-hand guiding elements being movable in said guiding orifice in such a way that a second portion of each right-hand, left-hand guiding element is forcefully and directly engaged in said right-hand, left-hand helix, in said drive position of each one of said right-hand, left-hand guiding elements.

In this application, "single" drum means a drum formed from a single piece or through the assembly of several pieces. "Element forcefully engaged in a helix" also means when it is not free to retract without a specific additional constraint. Finally, "separate" elements means elements which are not integral with each other, formed by two parts which, during the manufacture and of the mounting of the transformation device, can be manipulated independently one from the other. Moreover, "guiding element directly engaged in the helix" means that it is the guiding element itself that is engaged in the helix, not the guiding element which engages another part in the helix, the guiding element then not being itself engaged.

Thanks to these specific characteristics, the locking-wire pliers according to the invention is robust, simple to manufacture and able to be used in difficult conditions which still having a very good service life. Through its compactness, these pliers and their transformation device can moreover be used with a single main.

Said right-hand and left-hand guiding elements are more preferably angularly fixed with respect to said longitudinal axis of said pin.

Advantageously, said casing comprises at least one guiding housing and one bearing surface, said guiding housing being able to be in the alignment of the displacement of said right-hand, left-hand guiding element, in its free position, and to receive a third portion respectively of said right-hand, left-hand guiding element, said bearing surface being simultaneously able to be in the alignment of the displacement of said left-hand, right-hand guiding element in its drive position and to maintain said second portion of said left-hand, right-hand guiding element forcefully and directly engaged respectively in said left-hand, right-hand helix.

According to a preferred embodiment, said guiding housing is able to receive said third portion of said right-hand, left-hand guiding element, in its free position, without any portion of said right-hand, left-hand guiding element being engaged in said corresponding right-hand, left-hand helix, said right-hand, left-hand helixes, being able to receive said second portion of said right-hand, left-hand guiding element, in its drive position without any portion of said right-hand, left-hand guiding element, being engaged in said guiding housing, so that said right-hand, left-hand guiding elements, can exceed, in each position, only one end of said guiding orifice.

The height of said right-hand, left-hand guiding elements, is more preferably greater than the thickness of the wall of said drum on said guiding orifice so that said right-hand, left-hand guiding elements, constantly exceed at least one end of said guiding orifice.

Preferably, said means of coupling are arranged so that, in said right-hand position:

said guiding housing is not in the alignment of the displacement of said right-hand guiding element, and said bearing surface is in the alignment of the displacement of said right-hand guiding element, said guiding housing is in the alignment of the displacement of said left-hand guiding element, and said bearing surface is not in the alignment of the displacement of said left-hand guiding element, and that, in said left-hand position:

said guiding housing is in the alignment of the displacement of said right-hand guiding element, and said bearing surface is not in the alignment of the displacement of said right-hand guiding element, said guiding housing is not in the alignment of the displacement of said left-hand guiding element, and said bearing surface is in the alignment of the displacement of said left-hand guiding element.

Said drum comprises advantageously at least one connecting element arranged to be constantly forcefully engaged in one of said right-hand, left-hand helixes, according to the helix across from which it is located.

According to a preferred embodiment, said connecting element is offset angularly in a transversal plane, and/or longitudinally with respect to said guiding orifice in such a way that, when said connecting element is located at a first intersection of said right-hand and left-hand helixes, none of said right-hand and left-hand guiding elements are located at a second intersection of said right-hand and left-hand helixes.

Said drum can comprise a connecting orifice, radial, opening at least towards the inside of said drum, constantly closed off towards the outside of said drum and receiving said connecting element.

"Towards the inside" in this application means oriented towards the longitudinal axis C of revolution of the pin, and "towards the outside" means oriented by moving away from this longitudinal axis C.

This connecting orifice can pass through said drum and said casing can be provided, across from said connecting pass-through orifice, of a continuous connecting surface closing off said connecting orifice.

Advantageously, said means of coupling comprise means for blocking arranged to tend to maintain said casing and said drum in each one of said right-hand and left-hand positions.

Said means of blocking comprise more preferably at least two first abutments provided on one of said drum, casing and offset between them angularly or longitudinally, a second abutment coupled respectively to said casing, drum and able to cooperate successively with one of said first abutments and urged respectively towards said drum, casing by means of elastic return arranged so that the passage between said right-hand and left-hand positions is possible only after application of a predetermined force that is greater than that exerted by said means of elastic return.

According to a preferred embodiment, said drum, casing, comprises two blocking housings oriented towards said casing, said drum, and defining said first abutments, respectively said casing, said drum comprising a blocking orifice wherein is housed a blocking element defining said second abutment and a spring defining said means of elastic return and urging radially said blocking element respectively towards said drum, said casing, a portion of said blocking element being able to be housed in one of said blocking housings in each one of said right-hand and left-hand positions.

Preferably said means of coupling comprise means of guiding that authorise only one of the following relative mobilities: angular mobility in a transversal plane or longitudinal mobility, of said casing and of said drum between said right-hand and left-hand positions.

Said casing can be formed from a steel sheet comprising at least one deformation in the form of a bowl, oriented towards the outside, defining said guiding housing and an inside surface having a generator substantially similar to the exterior generator of said drum and defining said bearing surface.

Said drum comprises advantageously at least one right-hand guiding orifice able to constantly receive at least one portion of said right-hand guiding element and a left-hand guiding orifice able to constantly receive at least one portion of said left-hand guiding element.

Advantageously, said casing comprises at least one right-hand guiding housing able to receive the third portion of said right-hand guiding element in its drive position, a left-hand guiding housing able to receive the third portion of said left-hand guiding element in its drive position, a right-hand bearing surface able to maintain said right-hand guiding element in its drive position and a left-hand bearing surface able to maintain said left-hand guiding element in its drive position.

Said casing can be formed by at least two half-shells assembled together around said drum by the means for fastening.

According to a preferred embodiment, said means for guiding are arranged to allow only the angular mobility in a transversal plane of said casing with respect to said drum between said right-hand and left-hand positions, said right-hand guiding orifice, said right-hand bearing surface and said right-hand guiding housing being arranged on the same right-hand cone of revolution, said left-hand guiding orifice, said left-hand bearing surface and said left-hand guiding housing being arranged in the same left-hand cone of revolution, said first abutments, said second abutment and said blocking orifice being arranged in the same abutment cone of revolution, said first abutments being offset from one another angularly on said cone of revolution of abutments.

Said right-hand, left-hand cones of revolution are more preferably offset longitudinally with respect to one another.

Advantageously, at least one of said cones of revolution forms an angle of 180° and defines a transversal plane, and at least one of said right-hand, left-hand guiding orifices, connecting orifice, blocking orifice is substantially perpendicular to said longitudinal axis of said pin, said right-hand, left-hand guiding element, connecting element, corresponding blocking element being longitudinally fixed with respect to said pin.

Preferably, said drum comprises two lateral portions separated by a median portion having a reduced outer diameter with respect to that of said lateral portions and able to receive said half-shells of said casing, the difference in diameter between said median portion and said lateral portions defining at least partially said means for angular guiding.

According to a preferred embodiment, said means of coupling comprise at least one of the pairs chosen from the group comprising at least one pair of right-hand guiding housings each one provided with a right-hand guiding element, a pair of left-hand guiding housings each one provided with a left-hand guiding element, a pair of right-hand bearing surfaces, a pair of left-hand support surfaces, a pair of right-hand guiding housings, a pair of left-hand guiding housings, the two elements of the same pair being situated in the same transversal plane.

At least one of said right-hand, left-hand guiding elements, connecting element, blocking element, advantageously comprises a ball.

Said casing comprises more preferably means of anchoring intended to cooperate with at least one anchoring element external to said transformation device in order to prevent the rotation of said casing with respect to said external anchoring element.

Said drum and said casing are advantageously at least partially formed by at least one portion of a cylinder of revolution.

According to a preferred embodiment, said clamping jaws are each extended by a handle, said reversible locking-wire pliers comprising means for locking arranged to provide the maintaining in closed position of said handles when they are not urged and authorise the opening of said handles when they are urged, with a portion of said means for locking being combined with said means of anchoring.

According to a last preferred embodiment, the reversible locking-wire pliers comprise, on the one hand, a sharp portion on each one of its clamping jaws, said two sharp portions being arranged facing and able to cut a wire or similar and, on the other hand, a device for recovering scraps of wire or similar.

Preferably, the device for recovering comprises, on the one hand, a bit arranged on each one of two clamping jaws, said two bits being arranged facing at a right angle to the two sharp portions and able to be displaced substantially perpendicularly to the cutting plane P of said sharp portions and, on the other hand, means of pressure associated with said bits and exerting a force that tends to maintain the two bits in contact with each other when the clamping jaws are in closed position.

According to an alternative embodiment, the device for recovering comprises a deformable bit integral with each pressure jaw, said deformable bit being configured to be deformed in such a way as to exert a force that tends to maintain the two deformable bits in contact with each other when the clamping jaws are in closed position.

BRIEF DESCRIPTION OF THE FIGURES

Other advantages and characteristics shall appear better in the following description of an embodiment of a reversible locking-wire pliers according to the invention in reference to the annexed figures wherein:

FIG. 7A is a perspective view of an alternative of the reversible locking-wire pliers according to the invention, the reversible movement transformation device being shown transparently, the handles being in this figure in closed position but unlocked;

FIG. 7B is an enlarged detailed view of FIG. 7A;

FIG. 8 is an enlarged detailed view in elevation of the reversible locking-wire pliers according to the invention comprising a device for recovering scraps of wire or similar;

FIG. 9 is an enlarged detailed side view of the reversible locking-wire pliers according to the invention comprising a device for recovering scraps of wire or similar;

FIG. 11 is a cross-section view similar to FIG. 10 of an alternative embodiment of the device for recovering scraps of wire or similar.

BEST MODE FOR CARRYING OUT THE TECHNICAL INVENTION

In reference to the figures, the reversible locking-wire pliers 1 according to the invention comprise a pinching device 100 coupled to a reversible movement transformation device 200.

Figures 1A, 1B:
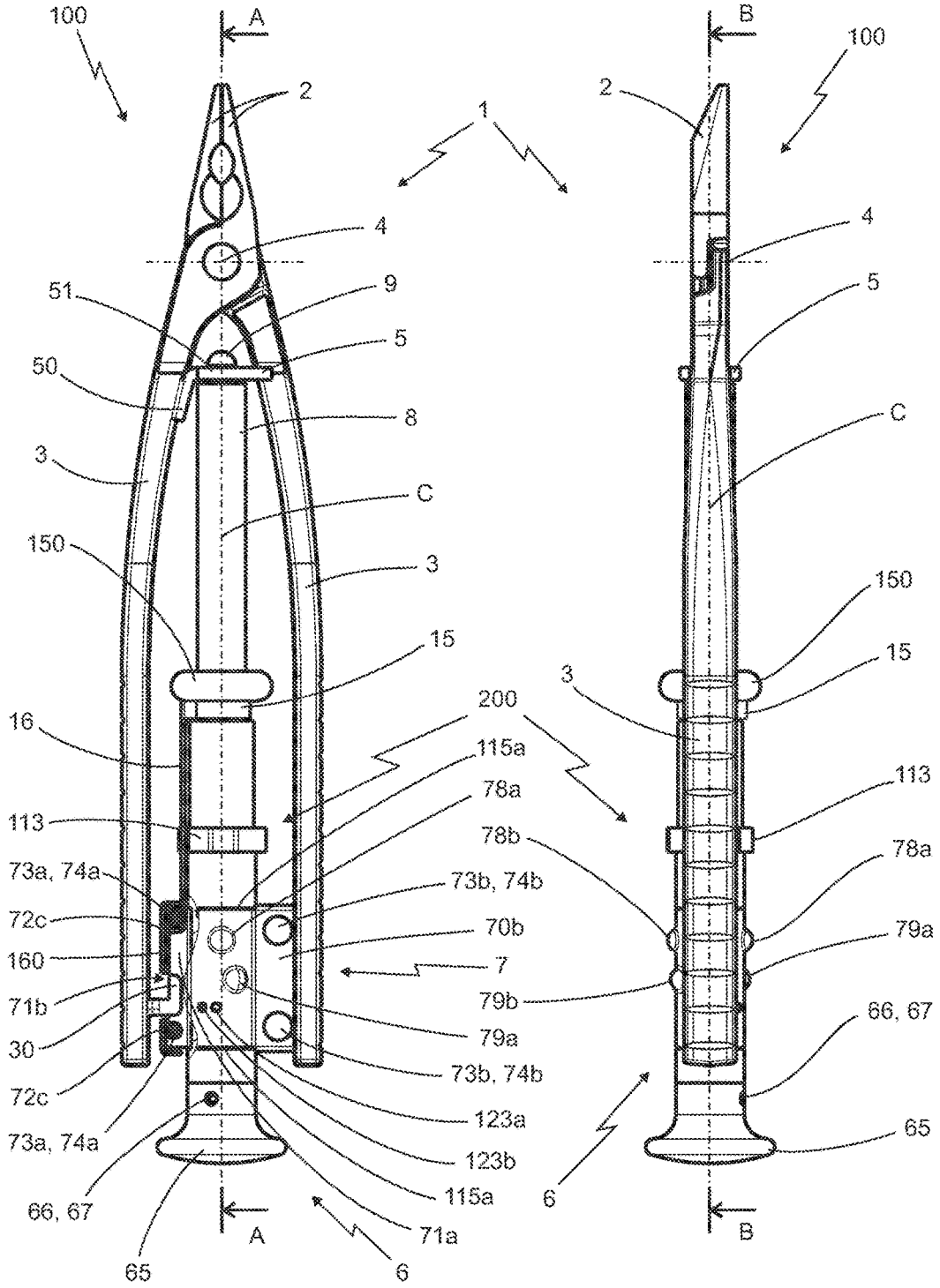
FIGS. 1A and 1B are respectively an elevation and side views of a reversible locking-wire pliers according to the invention comprising in particular jaws extended by handles and a reversible movement transformation device, the handles being on these figures in closed position but unlocked.
Figure 6A:
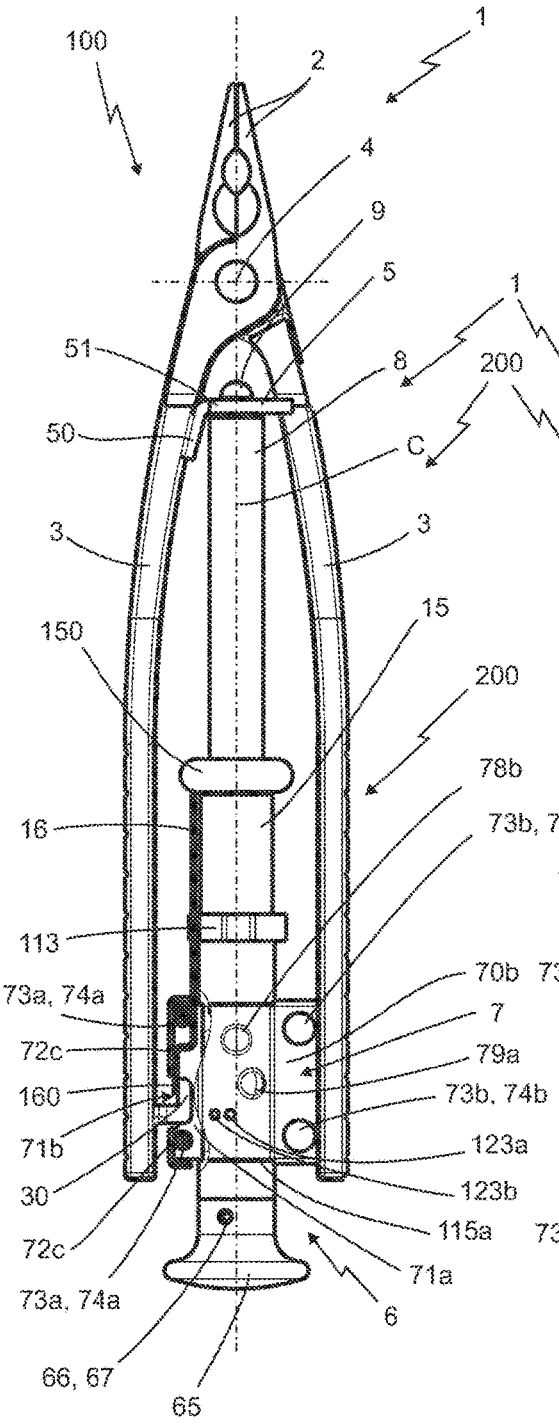
FIGS. 6A and 6B are similar respectively to FIGS. 1A and 5B and show the reversible locking-wire pliers when its handles are in closed position and locked.
Figure 6B:
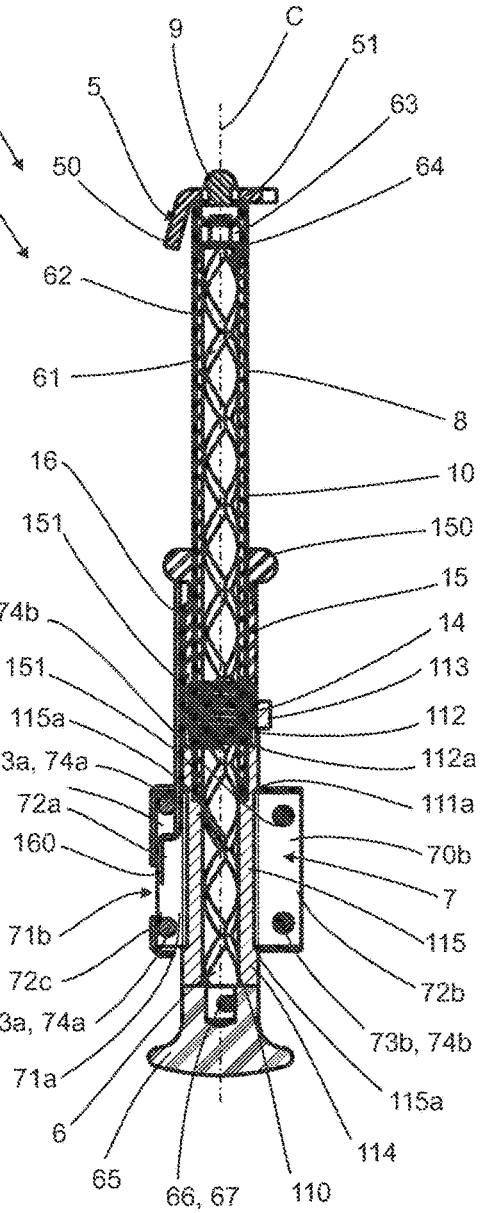

In reference in particular to FIGS. 1A, 1B and 6A, the pinching device 100 is known and comprises in particular two clamping jaws 2 each one extended by a handle 3. The clamping jaws 2 and the handles 3 are arranged in a cross and pivotally mounted on a pivot axis 4 about which they can be articulated between a closed position wherein the clamping jaws 2 are forced towards one another and exert between them a clamping pressure, and an open position wherein the clamping jaws 2 are not forced towards one another. The handles 3 have a length that is greater than that of the clamping jaws 2 which allows the user to benefit from a leverage effect that guarantees a good clamping pressure between the clamping jaws 2, and as such to effectively hold the metal wires to be twisted. The clamping jaws 2 and the handles 3 can be blocked in their closed position by means of locking described hereinbelow. The distal ends of the handles 3 are separated by a spring blade 5 comprising two wings 50, 51 inclined with respect to one another. A first wing 50 is integral with a first handle 3, the second wing 51 is free in such a way that, when the handles 3 are in closed position, the lateral edge of the second wing 51 is bearing against the other handle 3. The spring blade 5 is then elastically deformed between the two handles 3. In this position, the spring blade 5 tends to open the handles 3. After the unlocking of the handles 3, under the effect of the spring blade 5 which tends to return to its non-deformed state, the reversible locking-wire pliers 1 therefore begin to open on their own. The opening of the handles 3 is for example initiated by the spring blade 5 over an angle of about 15°. The opening force to be provided by the user is as such less and the good handling of the reversible locking-wire pliers 1 is guaranteed.

The transformation device 200 comprises a pin 6, movable in translation in relation to the pinching device 100 and able to be actuated manually. The transformation device 200 further comprises a casing 7 coupled to the pinching device 100 and means of coupling. The transformation device 200 is arranged to transform the translation in a first direction of translation of the pin 6 in rotation of the pinching device 100 in a first direction of rotation and as such generate a twisting of the wires directed in a first direction of twisting. The transformation device 200 is able to reverse the direction of the transformation of the movements and, after this inversion, to transform the translation in the same first direction of translation of the pin 6 in rotation of the pinching device 100 in a second direction of rotation, and as such generate a twisting of the wires oriented in a second direction of twisting. The wires can as such be twisted in a first direction then in a second direction, opposite the first direction and so on.

The pin 6 has the form of a shaft having a longitudinal axis C of revolution. The pin 6 is provided with two recessed helixes 61, 62, a right-hand helix 61 and a left-hand helix 62, with substantially identical pitches and profiles. The right-hand 61 and left-hand 62 helixes therefore cross at regular intervals over the length of the pin 6. According to an alternative embodiment not shown, the pin can be provided with a high number of right-hand and left-hand helixes, with the pitch between two helixes of the same direction then being a sub-multiple of the pitch of the same helix.

Said right-hand 61 and left-hand 62 helixes more preferably have a triangular profile provided with a curved bottom able to cooperate with balls (described hereinbelow) circulating in the right-hand 61 and left-hand 62 helixes in order to provide the transformation of movements while still guaranteeing a regular contact between the bottom of the right-hand 61 and left-hand 62 helixes and each ball. As such the operation of the reversible locking-wire pliers 1 is more flexible and gentle than that of known locking-wire pliers.

Figure 2:
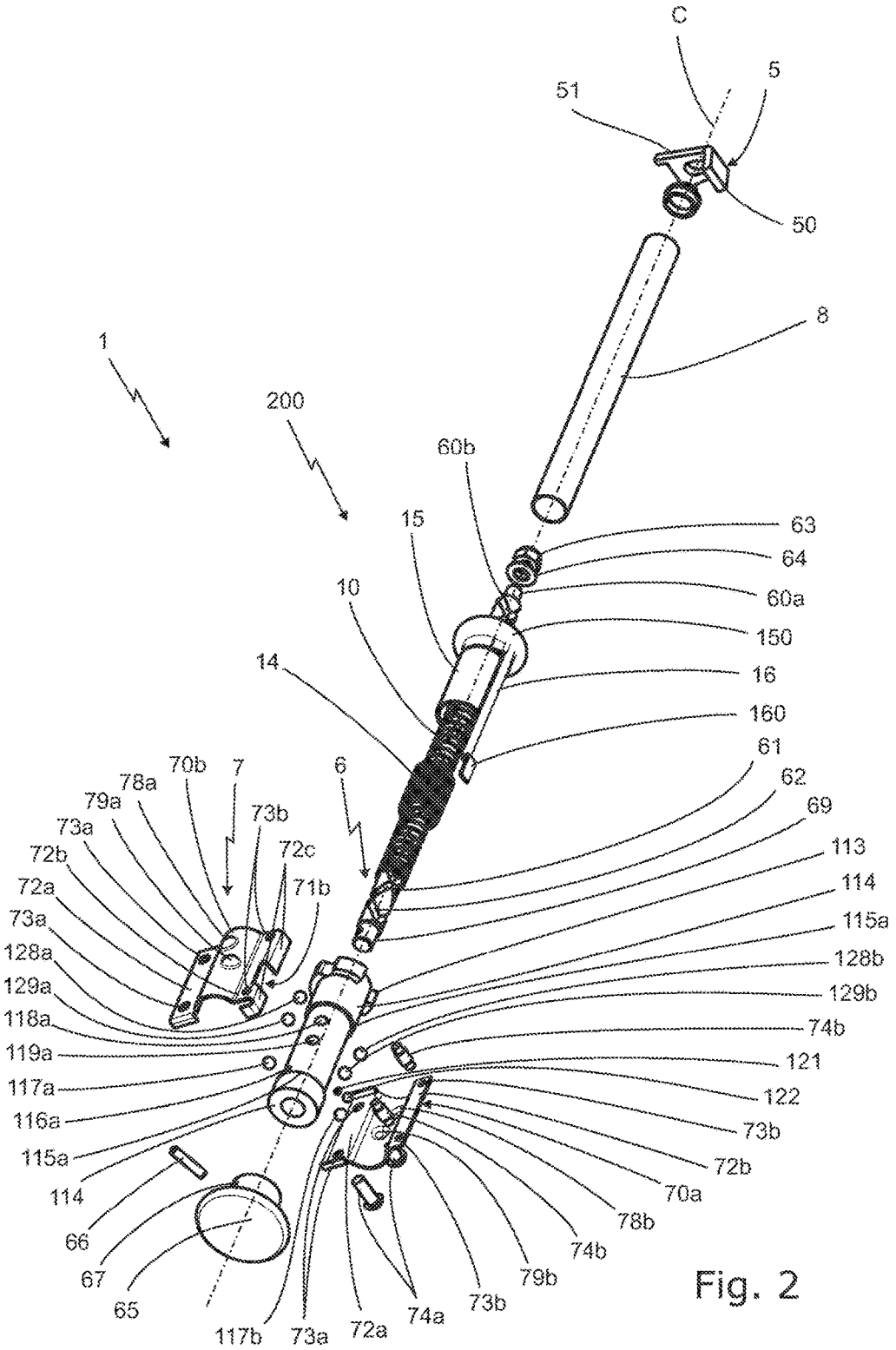
FIG. 2 is a partial exploded figure in perspective of the reversible locking-wire pliers of FIGS. 1A and 1B, the reversible locking-wire pliers being shown without its handles.

The distal portion of the pin 6 is housed in a guide tube 8 fixed to the second wing 51 of the spring blade 5 by means of a rivet 9. Any other suitable means can of course be used as a replacement for the rivet 9. The distal end of the pin 6 is provided with a threaded portion 60*a* (Cf. FIG. 2) with a diameter less than that of the rest of the pin 6 and defining a bearing shoulder 60*b*. The threaded portion 60*a* is able to receive a nut 63 blocking a bearing washer 64 between the nut 63 and the bearing shoulder 60*b*. This bearing washer 64 is used as a distal abutment for a main compression spring 10 threaded on the pin 6. The proximal portion of the pin 6 is housed in the casing 7 wherein it is guided, according to a helical connection, by the intermediary of the means for guiding allowing for the transformation of the translation of the pin 6, in rotation of the pinching device 100. The proximal end of the pin 6 is provided with a drawing button 65 able to be manipulated by a user in order to longitudinally draw and push the pin 6 in relation to the pinching device 100. This drawing button 65 comprises a non-through bore 68 receiving the distal end of the pin 6. The drawing button 65 is fixed to the pin 6 by means of a headless screw 66 passing through a threaded orifice 67 provided in the drawing button 65 and a smooth orifice 69 provided in the pin 6.

According to an alternative embodiment not shown, the orifice provided in the drawing button can be smooth and the orifice provided in the threaded pin. Any other suitable means of fastening can be used as a replacement for the headless screw and smooth and threaded orifices.

The means of coupling comprise a single drum 11, right-hand guiding elements and left-hand guiding elements. The drum 11 has the general shape of a cylindrical sleeve, passed through by a sleeve bore 110 slidingly threaded on the proximal portion of the pin 6. It is therefore situated between the pin 6 and a casing described hereinbelow. The relative freedom according to the longitudinal axis C between the drum 11 and the pin 6 is substantially zero. In addition to the sleeve bore 110, the drum 11 comprises a main bore 111 and a secondary bore 112 extending from the distal end of the drum 11, concentric with the sleeve bore 110 and with diameters greater than that of the sleeve bore 110. The diameter of the main bore 111 is moreover less than that of the secondary bore 112, and the length of the main bore 111 is greater than that of the secondary bore 112. The main shoulder 111*a*, formed by the difference in diameter between the main bore 111 and the sleeve bore 110, is used as a proximal abutment for the main spring 10. The secondary shoulder 112*a*, formed by the difference in diameter between the secondary bore 112 and the main bore 111, is used as a proximal abutment for a secondary spring 14 provided between the drum 11 and an actuating tube 15 of the means for unlocking described hereinbelow. The distal end of the drum 11 is provided with a thumb wheel 113 able to be manipulated by the user in order to angularly orient the drum 11 in relation to the casing 7. The proximal end of the drum 11 is bearing on the drawing button 65 against which the drum 11 is maintained in position by the intermediary of the main spring 10 provided between the bearing washer 64 and the main shoulder 111*a* of the drum 11.

The drum 11 comprises two lateral portions 114 separated by a median portion 115 with an outer diameter less than the diameter of the lateral portions 114. The median portion 115 is surrounded by the casing 7 described hereinbelow. The difference in diameter between the median portion 115 and the lateral portions 114 forms median shoulders 115*a* serving as means for guiding for the casing 7 by defining longitudinal abutments that make it possible to limit, the mobility between the casing 7 and the drum 11, to an angular mobility. In this example, the thickness of the casing 7 is substantially equal to the difference in diameter between the median portion 114 and the lateral portions 115 of the drum 11. The continuity between the outer diameters is as such provided.

According to other alternative embodiments not shown, the thickness of the casing can be less than or greater than this difference in diameter. According to yet another alternative embodiment not shown, the casing is extended by portions of a larger diameter and forms a deflection extending on either side of the median zone on top of the drum.

Figure 3A:
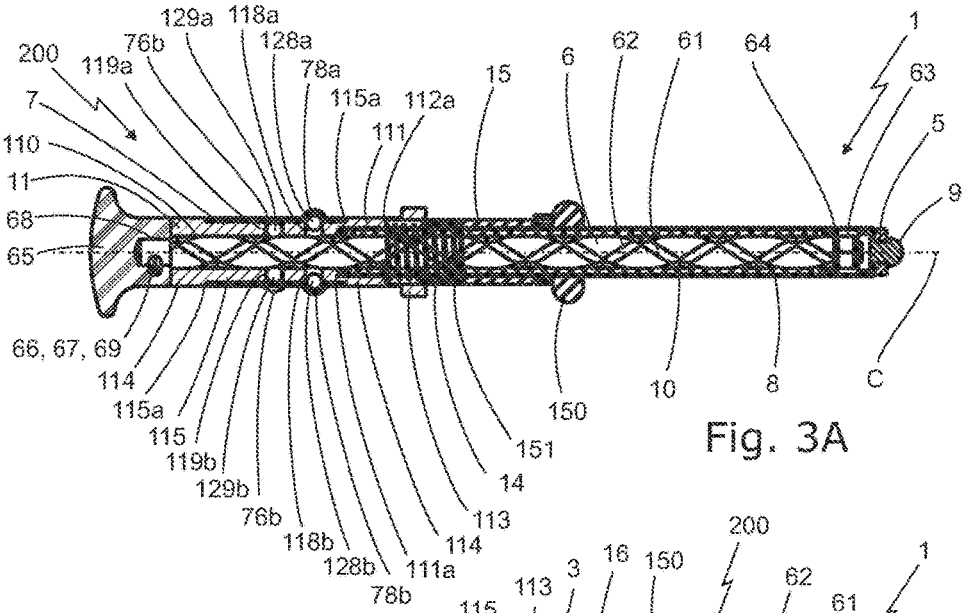
FIG. 3A is a cross-section view according to the cutting plane AA of FIG. 1A of the reversible locking-wire pliers shown without its handles and in a first configuration of transformation device corresponding to a first direction of rotation of the reversible locking-wire pliers.
Figure 3B:
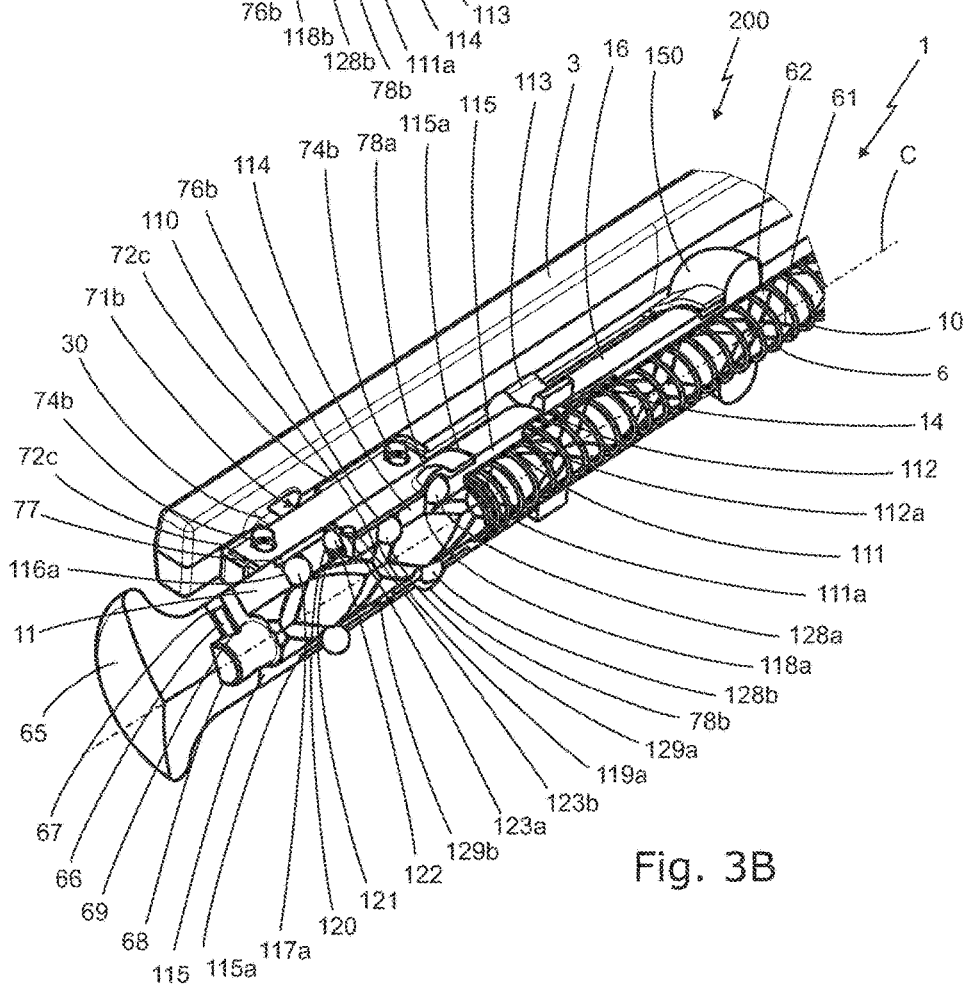
FIG. 3B is a partial cross-section view in perspective of the reversible locking-wire pliers of FIG. 3A.
Figure 4A:
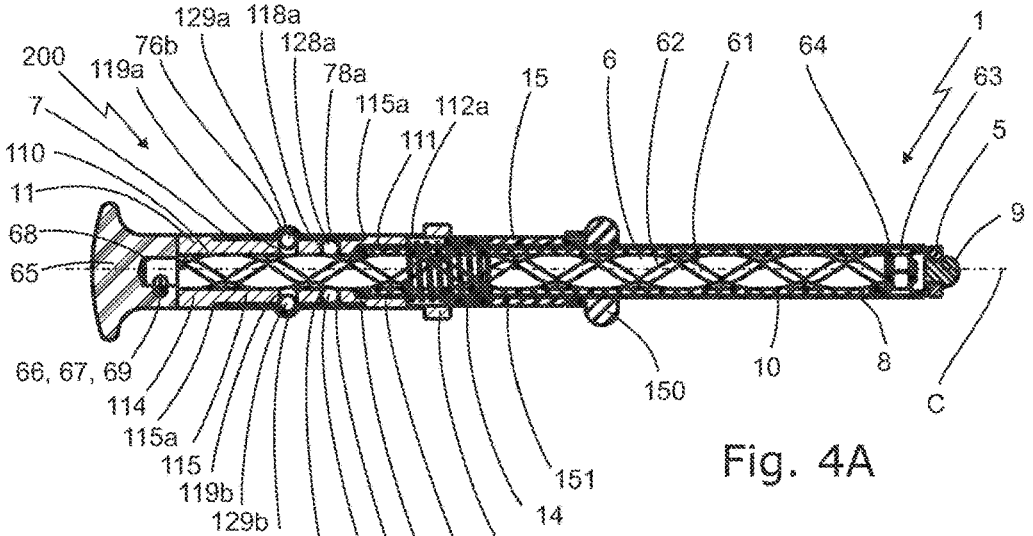
FIGS. 4A and 4B are views similar to FIGS. 3A and 3B of the reversible locking-wire pliers according to the invention in a second configuration of the transformation device corresponding to a second direction of rotation of the reversible locking-wire pliers.
Figure 4B:
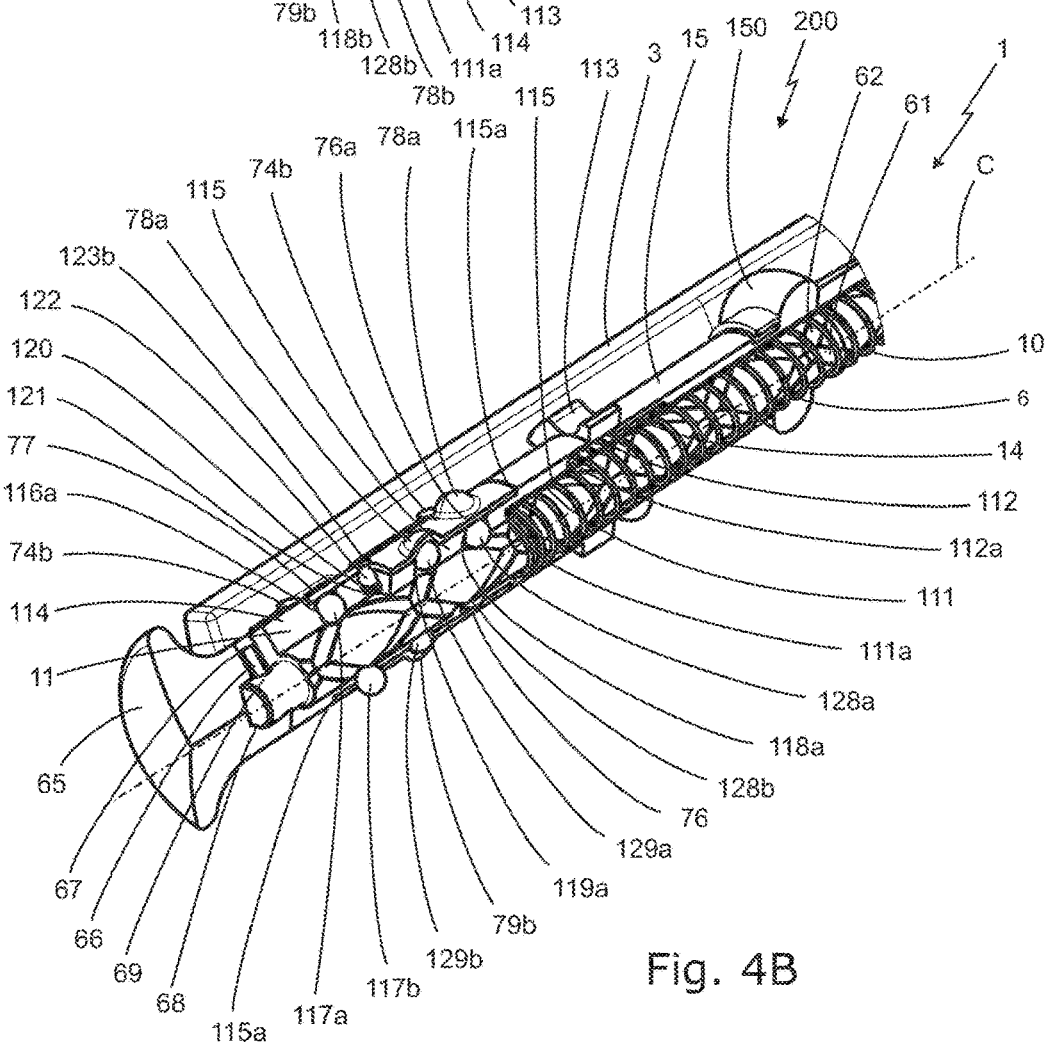
Figure 5A:
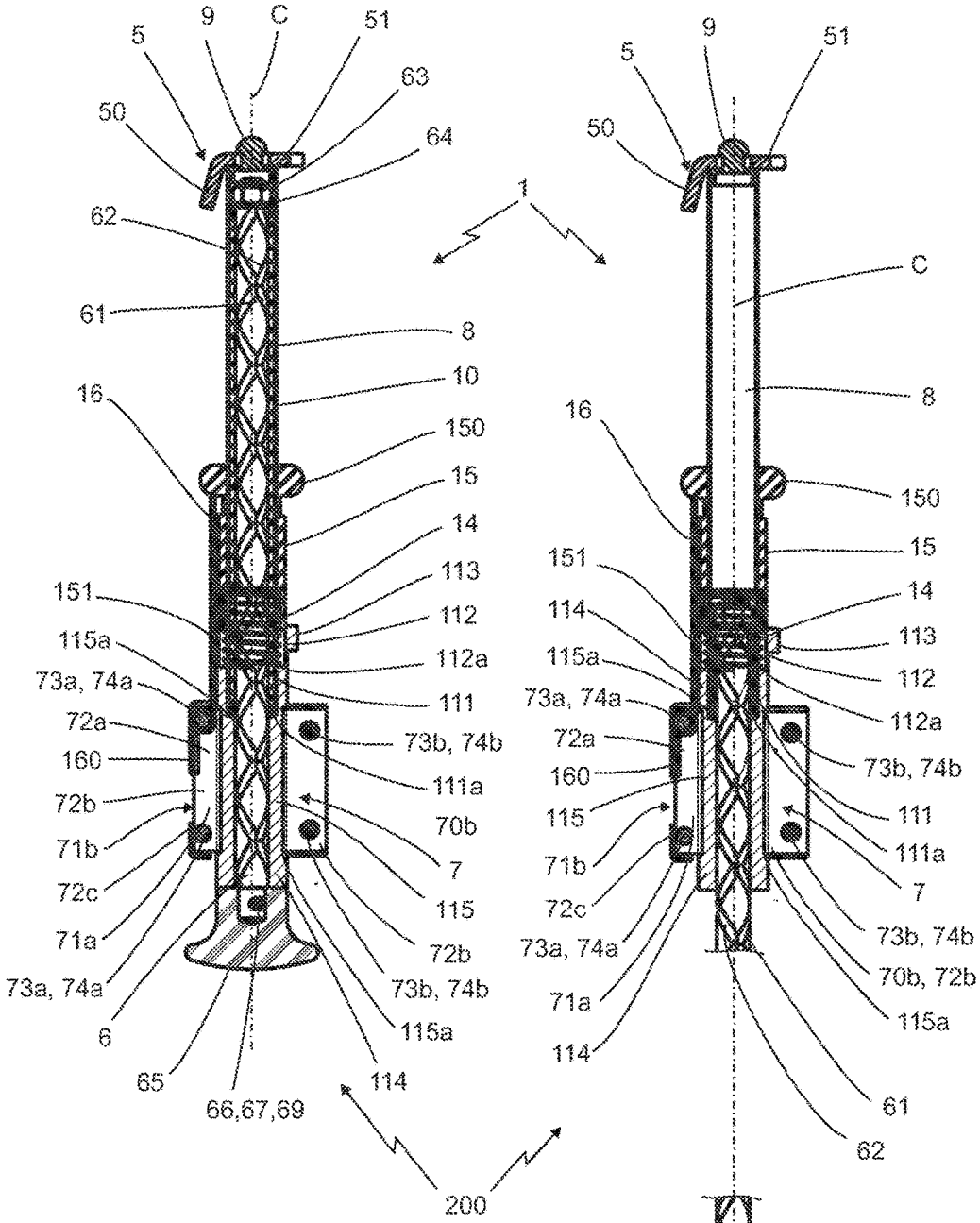
FIGS. 5A and 5B are cross-section views according to the cutting plane BB of FIG. 1B of the reversible locking-wire pliers respectively in "rest" position and in "rear" position of the double helix pin with respect to the jaws.
Figure 5B:
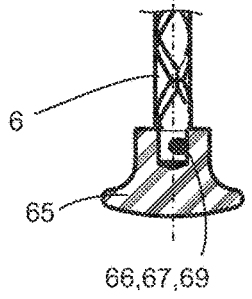

The drum 11 comprises, in the proximal portion of its median portion 115, a pair of radial connecting orifices 116*a, b* of which only one can be seen in FIGS. 3B and 4B. These connecting orifices 116*a, b* are arranged across from one another, in the same transversal plane, and they pass through the wall of the drum 11. The outer end of each connecting orifice 116*a, b* (end oriented towards the outside of the drum 11) is constantly closed off by the casing 7 surrounding the median portion 115 of the drum 11. To do this, the casing 7 comprises a continuous, circular connecting surface 77 (Cf. FIGS. 3B and 4B), able to simultaneously close off the outer end of the two connecting orifices 116*a, b*, regardless of the relative position of the casing 7 and of the drum 11. Each connecting orifice 116*a, b* receives a connecting ball 117*a, b* (Cf. FIGS. 3B and 4B) of which the diameter is greater than the height of the connecting orifice 116*a, b* and less than the distance that separates the connecting surface 77 from the bottom of the right-hand 61 or left-hand 62 helix across from the connecting orifice 116*a, b*. As such, the external portion of each connecting ball 117*a, b* (portion oriented towards the outside of the drum 11) is in contact with the casing 7 and the internal portion of each connecting ball 117*a, b* (portion oriented towards the inside of the drum 11) extends from the connecting orifice 116*a, b* towards the inside of the drum 11 in such a way as to be forcefully engaged in the right-hand helix 61, or in the left-hand helix 62 or in an intersection of the right-hand 61 and left-hand 62 helixes. The connecting balls 117*a, b* are as such constantly coupled to the pin 6 and maintain, in all circumstances, the helical connection between the drum 11 and the pin 6. The transversal plane, wherein are provided the connecting orifices 116*a, b*, is chosen to coincide, when the drum 11 is bearing against the drawing button 65, with a transversal plane of the pin 6 comprising intersections between the right-hand 61 and left-hand 62 helixes. As such, in the positions shown in FIGS. 3B and 4B and wherein the pin 6 is in the starting position, the connecting balls 117*a, b* are situated at the intersections of the right-hand 61 and left-hand 62 helixes, a particular position wherein the change in the direction of the transformation of movements of the transformation device 200 is possible. Indeed, starting from this particular position, the connecting balls 117*a, b* can be oriented to circulate either towards the right-hand helix 61, or towards the left-hand helix 62, giving a different movement transformation direction according to this orientation. After displacement of the pin 6 in relation to the drum 11, the connecting balls 117*a, b* are therefore either in the right-hand helix 61 or in the left-hand helix 62, until the next intersection of the right-hand 61 and left-hand 62 helixes, a new particular position wherein the direction of movement transformation can again be reversed.

According to an alternative embodiment not shown, the drum comprises a circular groove of low thickness provided across from the connecting orifices. In this alternative, the connecting ball, the groove and the connecting orifice are sized in such a way that the connecting ball is constantly forcefully engaged simultaneously in the groove and in the right-hand/left-hand helix across from which the connecting orifice is positioned.

According to another alternative embodiment not shown, the connecting orifices are non-through and open from the drum only towards the inside of the latter. In this configuration, the connecting orifices can be provided in the median portion or in the proximal lateral portion and the casing is free of a continuous connecting surface.

According to yet another alternative embodiment, the connecting orifices are inclined and are not perpendicular to the longitudinal axis C. When the connecting orifices do not open towards the outside of the drum, they can have different inclinations. When the orifices open towards the outside of the drum and are closed off by the connecting surface of the casing, the connecting orifices are more preferably provided on a cone of revolution centred about the longitudinal axis C.

The drum 11 further comprises, in its median portion 115, a pair of right-hand guiding orifices 118*a, b* (Cf. FIGS. 2 to 4B) and a pair of radial left-hand guiding orifices 119*a, b* (Cf. FIGS. 2 to 4B). The right-hand guiding orifices 118*a*, 118*b* are arranged in a first transversal plane and the left-hand guiding orifices 119*a, b* are arranged in a second transversal plane, offset in relation to the first transversal plane by a value different from the pitch of the right-hand 61, left-hand 62 helixes. Each right-hand 118*a, b* and left-hand 119*a, b* guiding orifice passes through the wall of the drum 11. The right-hand guiding orifices 118*a, b* and the left-hand guiding orifices 119*a, b* are arranged in such a way that, in the particular position of inversion of the movement transformation direction, each one of the right-hand guiding orifices 118*a, b* is located across from the right-hand helix 61 and that each one of the left-hand guiding orifices 119*a, b* is located across from the left-hand helix 62. The right-hand 118*a, b* and left-hand 119*a, b* guiding orifices are moreover distally and angularly offset in the transversal plane in relation to the connecting orifices 116 in such a way that, in the particular position, when the connecting orifices 116 are across from an intersection of the right-hand 61 and left-hand 62 helixes of the pin 6, the right-hand 118*a, b* and left-hand 119*a, b* guiding orifices are not across from such an intersection. The fact that the drum 11 comprises pairs of right-hand 118*a, b* and left-hand 119*a, b* guiding orifices confers good robustness to the transformation device 200.

Each one of the right-hand 118*a, b* and left-hand 119*a, b* guiding orifices respectively receives a right-hand guiding ball 128*a, b* (Cf. FIGS. 2 to 4B), a left-hand guiding ball 129*a, b* (Cf. FIGS. 2 to 4B) defining respectively the right-hand and left-hand guiding elements. The diameter of each right-hand 128*a, b* and left-hand 129*a, b* guiding ball is greater than the height respectively of the right-hand 118*a, b* and corresponding left-hand 119*a, b* guiding orifice, in such a way that it constantly exceeds at least on one side of the right-hand 118*a, b* and corresponding left-hand 119*a, b* guiding orifice. In this example, the first right-hand guiding orifice 118*a* is longitudinally aligned with the first left-hand 119*a* guiding orifice. Likewise, the second right-hand guiding orifice 118*b* is aligned with the second left-hand guiding orifice 119*b*.

Each right-hand 128*a, b*, left-hand 129*a, b* guiding ball is radially movable between a drive position wherein it exceeds the inside end of the right-hand 118*a, b*, corresponding left-hand 119*a, b* guiding orifice, and a free position wherein it exceeds the outside end of the right-hand 118*a, b*, left-hand 119*a, b* guiding orifice. The casing 7 comprises right-hand 78*a, b* and left-hand 79*a, b* guiding housings each able to receive the portion of the right-hand 128*a, b*, left-hand 129*a, b* guiding ball that extends from the right-hand 118*a, b*, left-hand 119*a, b* guiding orifice when it is in its free position. The circular surfaces separating the right-hand guiding housings 78*a, b* and the surfaces separating the left-hand guiding housings 79*a, b* define right-hand 76*a* and left-hand 76*b* bearing surfaces (Cf. FIGS. 3A to 4B) able to force the right-hand 128*a, b* and left-hand 129*a, b* guiding balls in their drive position. The diameter of the right-hand 128 and left-hand 129*a, b* guiding balls is less than the distance respectively separating the external end of said right-hand 118*a, b*, left-hand 119*a, b* guiding orifice from the bottom of the right-hand 61, corresponding left-hand 62 helix and less than the distance separating the internal end of the right-hand 118*a, b*, left-hand 119*a, b* guiding orifice from the bottom of the right-hand 78*a, b* and corresponding left-hand 79*a, b* guiding housing. As such, in its drive position, each right-hand 128*a, b*, left-hand 129*a, b* guiding ball is forcefully engaged in the right-hand 61 and corresponding left-hand 62 helix and not engaged in the casing 7. In addition, in its free position, each right-hand 128*a, b*, left-hand 129*a, b* guiding ball is free to release itself from the right-hand 61 and left-hand 62 helix and be housed on the right-hand 78 and corresponding left-hand 79 guiding housing of the casing 7. The right-hand 78*a, b* and left-hand 79*a, b* guiding housings and the right-hand 76*a* and left-hand 76*b* bearing surfaces are arranged in such a way that:

in a first predetermined angular position of the casing 7 in relation to the drum 11 the right-hand guiding housings 78*a, b* are across from the right-hand guiding orifices 118*a, b* and the left-hand bearing surfaces 76*b* are across from the left-hand guiding orifices 119*a, b* and that in a second predetermined angular position of the casing 7 in relation to the drum 11 the left-hand guiding housings 79*a, b* are across from the left-hand guiding orifices 119*a, b* and the right-hand bearing surfaces 76*a* are across from the right-hand guiding orifices 118*a, b*.

In an alternative embodiment not shown, the drum comprises a unique right-hand guiding orifice, a single right-hand guiding ball, a single right-hand bearing surface, a single right-hand guiding housing and a single left-hand guiding orifice, a single left-hand guiding ball, a single left-hand bearing surface, a single left-hand guiding housing.

In the example shown, the right-hand 118*a, b* and left-hand 119*a, b* guiding orifices and the connecting orifices 116*a, b* have substantially similar diameters, the connecting balls 117*a, b* and the right-hand 128*a, b* and left-hand 129*a, b* guiding balls are substantially similar.

The casing 7 is formed by two half-shells 70*a*, 70*b* (Cf. FIGS. 1A to 2) made of sheet metal, assembled together around the drum 11 by means for fastening. In reference to FIGS. 2, 5A, 5B, 6A and 6B, each half-shell 70*a*, 70*b* is laterally extended by two lateral wings 72*a*, 72*b* (Cf. FIG. 2), one wing for fastening 72*a* provided with two orifices 73*a* able to receive the passage of rivets 74*a* blocking the half-shells 70*a*, 70*b* with respect to one another and one wing for coupling 72*b* provided with two orifices 73*b* able to receive the ends of spacers 74*b* provided between the coupling wings 72*b* in such a way as to preserve a free space between them, this free space delimiting a chamber 71*a*. These spacers 74*b* have the shape of cylindrical pins of which the ends have a diameter that is less than that of their central portion in order to authorise the passing of these ends in the orifices 73*b* and the bearing of the coupling wings on the spacer shoulder formed by this difference in diameters. The fastening wing 72*a*, coupling wing 72*b*, orifices 73*a, b* rivets 74*a* and spacers 74 define means for fastening.

As is detailed hereinafter the chamber 71*a* formed as such by the fastening 72*a* and coupling 72*b* wings, is able to receive a portion of the means for locking. One of the fastening wings 72*a* is extended towards the other fastening wing 72*a* by two flaps 72*c* (Cf. FIG. 2), aligned between them and separated by a central interval. As such, when the half-shells 70*a*, 70*b* are assembled, the flaps 72*c* close laterally, partially, the chamber 71*a* while still preserving a central opening 71*b*. This central opening 71*b* partially forms the means for locking. The opposite ends of the flaps 72*c* are moreover extended radially, towards the axis of the pin 6, by additional flaps that contribute to closing the chamber 71*a*. Each half-shell 70*a*, 70*b* comprises bowl-shaped deformations oriented towards the outside of the drum 11 and defining the right-hand 78*a, b* and left-hand 79*a, b* guiding housings. These deformations are separated by surfaces of curvature similar to that of the drum 11 defining the right-hand 76*a* and left-hand 76*b* bearing surfaces.

The drum 11, guided by the median shoulders 115*a* of the casing 7, can be displaced angularly between two positions: a right-hand position and a left-hand position.

In the right-hand position, on the one hand, the right-hand guiding orifices 118*a, b* are across from the right-hand bearing surfaces 76*a*, the right-hand guiding balls 128*a, b* are in their drive position, forcefully engaged in the right-hand 61 helixes and, on the other hand, the left-hand guiding orifices 119*a, b* are across from the left-hand guiding housings 79*a, b*, the left-hand guiding balls 129*a, b* are in their free position wherein they can be released from the left-hand 62 helixes in order to be housed in the left-hand guiding housings 79*a, b*, and as such authorise the rotation of the drum 11 and of the casing 7 in a first direction of rotation.

In the left-hand position, on the one hand, the left-hand guiding orifices 119*a, b* are across from the left-hand support surfaces 76*b*, the left-hand guiding balls 129*a, b* are in their drive position, forcefully engaged in the left-hand 62 helixes and, on the other hand, the right-hand guiding orifices 118*a, b* are across from the right-hand guiding housings 78*a, b*, the right-hand guiding balls 128*a, b* are in their free position wherein they can be released from the right-hand 61 helixes in order to be housed in the right-hand guiding housings 78*a, b* and as such authorise the rotation of the drum 11 and of the casing 7 in a second direction of rotation, opposite the first direction of rotation.

The transformation device 200 according to the invention further comprises means for blocking that tend to maintain the casing 7 and the drum 11 in one of the left-hand or right-hand positions. To do this, the drum 11 further comprises, in its median portion, a blocking orifice 120 (Cf. FIGS. 3B and 4B) oriented towards the outside of the drum 11 and provided in a transversal plane situated between the transversal planes comprising the right-hand 118*a, b*, left-hand 119*a, b* guiding orifices and the connecting orifices 116*a, b*. In this example, the blocking orifice 120 has a diameter less than that of the right-hand 118*a, b*, left-hand 119*a, b* guiding orifices and of the connecting orifices 116*a, b*. The blocking orifice 120 is provided as non-through towards the inside of the drum 11 and comprises a blocking ball 122 with a diameter less than the height of the blocking orifice 120 and defining a blocking element. As such, the locking ball 122 can be retracted into the blocking orifice 120 in such a way as to not exceed it. The locking ball 22 is urged towards the outside of the drum 11 by a blocking compression spring 121. The casing 7 comprises, in the same plane as the blocking orifice 22, two blocking housings 123*a, b* angularly offset with respect to one another, provided inside the casing 7 and oriented towards the outside of the casing 7. These blocking housings 123*a, b* are provided as through and in a plane substantially confounded with that comprising the blocking orifice 120. The positions of the blocking housings 123*a, b* are provided in such a way that, in the right-hand position, the blocking orifice 120 is across from a first blocking housing 123*a* and that, in the left-hand position, the blocking orifice 120 is across from the second blocking housing 123*b*. In each one of these right-hand and left-hand positions, the locking ball 122, pushed by the blocking spring 21, is able to be housed partially in the corresponding blocking housing 123*a, b* in order to tend to block the relative position between the casing 7 and the drum 11 in one of the right-hand and left-hand positions. As such, the passage between the right-hand and left-hand positions is possible only after application of a predetermined force, greater than that exerted by the blocking spring 21 on the locking ball 22. The blocking housings 123*a, b* define the first abutments means for blocking. The locking ball 122 and the blocking orifice 120, to which it is coupled, define the second abutment of the same means of blocking. In the example shown, the blocking orifice 120 is longitudinally aligned with the connecting orifice 116. They can also not be aligned. Likewise, in this example, the blocking housings 123*a, b* are substantially aligned longitudinally with the guiding housings 78*a, b*. They can also not be aligned.

In order to displace the drum 11 in relation to the casing 7, between its right-hand position and its left-hand position and vice versa, the user pivots the drum 11 by means of the thumb wheel 113 respectively towards the left then towards then towards the right then again towards the right and finally towards the left. The force of rotation to be applied by the user on the drum 11 is necessarily greater than that applied by the blocking spring 121. As this movement is a movement of rotation over a limited angle, it can easily be carried out by a finger of the user of whom the rest of the hand holds the reversible locking-wire pliers 1.

In this example, the blocking orifice 120 is provided in a transversal plane. According to an alternative embodiment not shown, the blocking orifice can be provided inclined, the blocking housings are then also provided inclined, in its extension. According to another alternative embodiment not shown, the blocking orifice is provided on the casing and the blocking housings are provided on the drum. Likewise, the means of elastic return can comprise an elastically deformable lug, an elastic blade or any other similar element. The locking ball and the compression spring can finally be replaced with a single elastically deformable part.

According to an alternative embodiment not shown, the blocking that tends to maintain the casing 7 and the drum in one of the right-hand or left-hand positions is obtained by the cooperation of the elastically deformable latch 16, of which the distal end is integral with the locking button 150, and with recesses arranged on the drum 11.

The means for locking the pinching device comprise a hook 30, integral with one of the handles 3, and provided across from the central opening 71*b* of the casing 7 in such a way that, when the handles 3 are in closed position, the hook 30 can be engaged in the central opening 71*b*. The means for locking also comprise an actuating tube 15 surrounding the pin 6, the main spring 10 and the secondary spring 14. The actuating tube 15 is movable in longitudinal translation with respect to the pin 6 between an unlocked position wherein it authorises the opening of the handles 3 and a locked position wherein it prevents the opening of the handles 3. The distal end of the actuating tube 15 is provided with a locking button 150 that can be manipulated by the user in order to displace the actuating tube 15. The proximal end of the actuating tube 15 is provided with an actuating bore 151 wherein the distal end of the secondary spring 14 is housed. This distal end is able to be displaced in the secondary bore 112 of the drum 11 until abutment, in the locked position, on the secondary shoulder 112*a*, the secondary spring 14 then being compressed and tending to push back the actuating tube 15 distally towards its unlocked position. The actuating tube 15 is coupled to an elastically deformable latch 16, of which the distal end is integral with the locking button 150. The proximal end of the latch 16 has the shape of a half-slot comprising an anchoring wing 160 substantially parallel to the longitudinal axis C and offset from the rest of the latch 16. The proximal end of the latch 16 is housed in the chamber 71*a* in such a way that the anchoring wing 160 is able to be engaged behind the hook 30, when the handles 3 are in their closed position and the user proximally displaces the actuating tube 15. In this closed position of the handles, when the anchoring wing 160 is engaged behind the hook 30, the user can release the handles 3 which are maintained in their closed position and locked by the anchoring wing 160. To this effect, the secondary spring 14 and the spring blade 5 are chosen in such a way that the force exerted by the spring blade 5 and which tends to separate the handles 3 is greater than the force exerted by the secondary spring 14 to return the actuating tube 15 in its unlocked position. In order to unlock the opening of the reversible locking-wire pliers 1, the user exerts a clamping pressure on the handles 3. The hook 30 is then displaced towards the longitudinal axis C of the pin 6, releasing the anchoring wing 160. The latch 16 and the actuating tube 15 are pushed towards their unlocked position by the secondary spring 14. The hook 30 is then free to exit from the chamber 71*a*. When the user releases the clamping pressure that he exerted on the handles 3, the spring blade 5 opens the handles 3 over about 15°. The reversible locking-wire pliers 1 can then be opened more fully. The gestures required by the operations of locking and of unlocking can be carried out with a single hand by the user. The handling of the reversible locking-wire pliers 1 according to the invention is as such very good.

The mode for using the reversible locking-wire pliers 1 according to the invention is described hereinafter.

In a first step, the reversible locking-wire pliers 1 being in open position, the user grasps them and, by means of the handles 3, closes the clamping jaws 2 on the metal wires to be twisted (not shown). Once the handles 3 are closed the user proximally displaces the actuating tube 15 by means of the locking button 150 until the proximal end of the actuating tube 15 is in abutment against the secondary shoulder 112*a* of the drum 11 and the secondary spring 14 is compressed. The user then releases the clamping pressure applied on the handles 3. The handles 3 are urged towards their open position by the spring blade 5. The anchoring wing 160 is then wedged behind the hook 30 and the actuating tube 15 can be released. The reversible locking-wire pliers 1 is in its closed and locked position, the wires being solidly maintained between the jaws 3.

The reversible locking-wire pliers 1 are in a particular position referred to as a change in direction wherein the connecting balls 117*a, b* are situated at an intersection between the right-hand 61 and left-hand 62 helixes, the right-hand guiding balls 128*a, b* across from a left-hand 61 helix, the left-hand guiding balls 129*a, b* across from a left-hand helix 62 and the drum 11 can be angularly oriented towards the right or towards the left. In the case of FIGS. 3A and 3B, the drum 11 was oriented towards the right and is in its left-hand position wherein the left-hand support surfaces 76*b* are across from the left-hand guiding orifices 119*a, b* and the right-hand guiding housings 78*a, b* are across from the right-hand guiding orifices 118*a, b*.

In a second step, the user draws proximally on the drawing button 65 which drives the pin 6 in translation. The left-hand guiding balls 129*a, b* are forced into the left-hand 62 helixes, the right-hand guiding balls 128*a, b* retract into the right-hand guiding housings 78*a, b* by following the transversal profile of the right-hand helix 61 and the drum 11 is driven in a movement of rotation towards the left, the metal wires are twisted towards the left. At the same time, the connecting balls 117*a, b* circulate in the left-hand 62 helixes in order to guarantee good guiding.

In a third step, in order to change the direction, the user takes advantage of a new particular position wherein the connecting balls 117*a, b* are situated at an intersection between the right-hand 61 and left-hand 62 helixes, the right-hand guiding balls 128*a, b* across from a left-hand 61 helix, the left-hand guiding balls 129*a, b* across from a left-hand helix 62 in order to orient the drum 11 towards the left, towards its right-hand position wherein the right-hand bearing surfaces 76*a* are across from the right-hand guiding orifices 118*a, b* and the left-hand guiding housings 79*a, b* are across from the left-hand guiding orifices 119 *a, b*.

In a fourth step, the user draws proximally on the drawing button 65 which drives the pin 6 in translation. The right-hand guiding balls 128*a, b* are forced into the right-hand 61 helixes, the left-hand guiding balls 129*a, b* retract into the left-hand guiding housings 79*a, b* by following the transversal profile of the left-hand helix 62 and the drum 11 is driven in a movement of rotation towards the right, the metal wires are twisted towards the right. At the same time, the connecting balls 117*a, b* circulate in the right-hand 61 helixes in order to guarantee good guiding.

In a fourth step, the user can take advantage of a new particular position in order to change the direction and repeat the operations of the second, third and fourth steps, for example until the pin 6 is at the end of travel, for example after a course of travel of about 80 mm.

Finally, the user unlocks the reversible locking-wire pliers 1 in order to release the twisted metal wires by exerting an additional clamping pressure on the handles 3. The hook 30 is then displaced towards the longitudinal axis C of the pin 6, releasing the anchoring wing 160. The reversible locking-wire pliers 1 are then in their unlocked closed position. The secondary spring 14 distally displaces the latch 16 and the actuating tube 15. The hook 30 is then free to exit from the chamber 71*a*. The user releases the clamping pressure and the handles 3 open. The reversible locking-wire pliers 1 are then in their open position. When the pin 6 is released, it is automatically reset in its non-drawn position by the main spring 10 which displaces it distally towards its starting position. The twisted wires are free. The reversible locking-wire pliers 1 can then be used to twist other metal wires.

In the example shown, the connecting housings are provided towards the proximal end of the pin, followed, by moving towards the distal end of the pin, by the blocking orifice then by the right-hand/left-hand orifices and finally by the left-hand/right-hand orifices. This arrangement can of course be different and, in an alternative embodiment not shown, it can as such be provided that the right-hand/left-hand orifices be situated towards the proximal end of the pin, followed, by moving towards the distal end of the pin, by the blocking orifice and by the connecting orifice or vice versa.

In another alternative embodiment not shown, each right-hand and left-hand connecting ball and blocking ball is replaced with a different connecting element, right-hand and left-hand guiding element and blocking element, for example a cylindrical pin or any other suitable element.

According to an alternative embodiment of the invention, the casing and drum comprise additional differences in diameter and a constant or variable thickness over their length.

Figure 8:
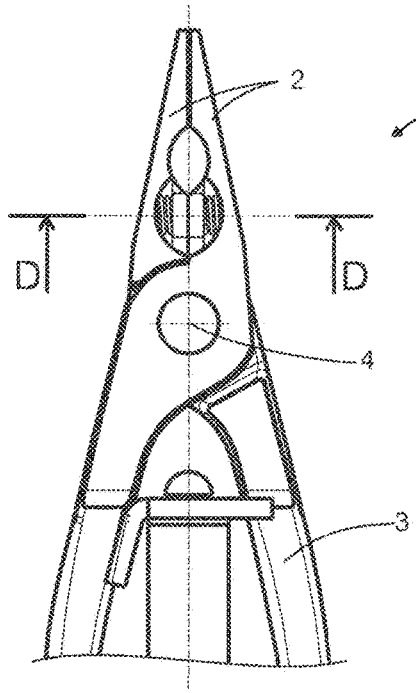
Figure 9:
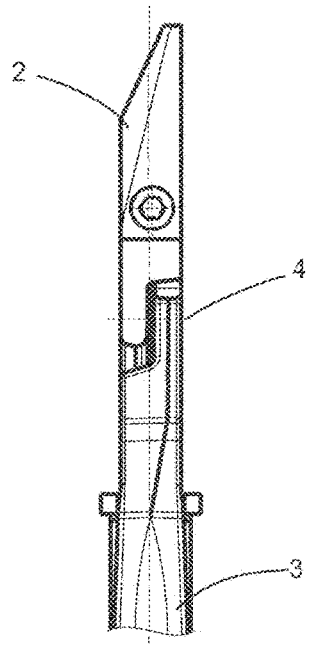
Figure 10:
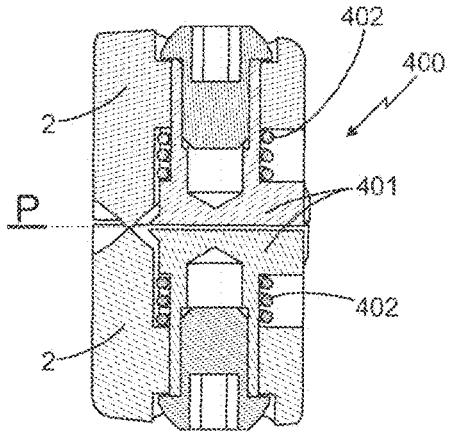
FIG. 10 is a cross-section view according to the cutting plane DD of FIG. 8.

Finally, in reference to FIGS. 8 to 10, the reversible locking-wire pliers 1 make it possible to twist metal wires then to seal them by means of a seal, but also to cut the excess metal wires after sealing. For this, said reversible locking-wire pliers 1 comprises advantageously, on each one of its clamping jaws 2, a sharp portion 12 arranged in the vicinity of the pivot axis 4 of the clamping jaw 2 and handle 3 units, said two sharp portions 12 being arranged facing and able to cut a wire or similar.

However, in order to respond to the expectations of certain customers and/or requirements of certain markets such as, for example, civil aviation or military, the reversible locking-wire pliers 1 must be compliant with the anti-FOD standard (Foreign Object Debris). For this, the reversible locking-wire pliers 1 comprise advantageously, a device for recovering 400 scraps of wire or similar.

This device for recovering 400 comprises a bit 401 arranged on each one of two clamping jaws 2, said two bits 401 being arranged facing at a right angle to the two sharp portions 12 and able to be displaced substantially perpendicularly to the cutting plane P of said sharp portions 12. Said bits 401 are associated with means of pressure 402 exerting a force that tends to maintain the two bits 401 in contact with one another when the clamping jaws 2 are in closed position, the means of pressure 402 being more preferably helical springs.

As such, with such a configuration, when cutting the wire with the reversible locking-wire pliers 1 has been completed, the device for recovering 400 the scrap wire as well as the clamping jaws 2 of said pliers 1 remain in closed position. On the other hand, as soon as the clamping jaws 2 of the reversible locking-wire pliers 1 open, the scrap wire falls. It is understood that this device for recovering 400 makes it possible to prevent any untimely falling of debris.

Figure 11:
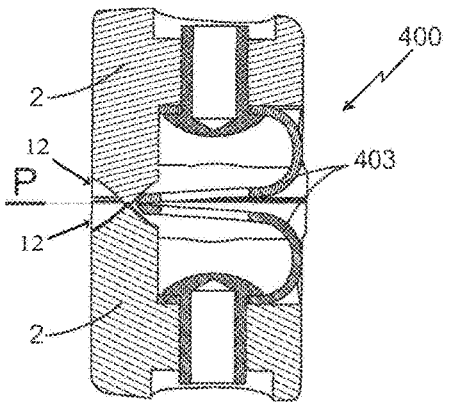

In reference to FIG. 11, each bit 401 and means of pressure 402 unit is replaced with a single and same part, namely a deformable bit 403 integral with the associated pressure jaw 2. Said deformable bit 403 is advantageously a metal blade with the general shape of a C configured to be deformed in such a way as to exert a force that tends to maintain the two deformable bits 403 in contact with one another when the clamping jaws 2 are in closed position.

Description of Embodiments

According to another embodiment not shown, the outer surface of the drum and the inner surface of the casing are tapered.

According to yet another embodiment not shown, the casing and the drum comprise means of guiding that authorise between them only a longitudinal mobility in order to pass from the right-hand position to the left-hand position. These means for guiding are for example formed of a groove provided on the drum or on the casing wherein circulates a guiding finger provided respectively on the casing or on the drum. In this embodiment the right-hand guiding housings and right-hand bearing surfaces are offset and aligned longitudinally. They are no longer offset angularly in a transversal plane as described above. The same applies pour the left-hand guiding housings and left-hand support surfaces. In addition, the right-hand and left-hand blocking housings are offset between them and aligned longitudinally. Finally, the connecting surfaces are sufficiently long to close off the connecting orifice in each one of the right-hand and left-hand positions.

Finally, according to a last other embodiment shown in the FIGS. 7A and 7B, the locking-wire pliers 1 comprise a reversible movement transformation device 300 which comprises a drum 211 similar to the drum 11 described hereinabove.

However, this drum 211 comprises, in its median portion 215, two pairs of right-hand guiding orifices 218*a* and two pairs of radial left-hand guiding orifices 219*a*. Each pair of right-hand guiding orifices 218*a* is arranged respectively in a first and a second transversal plane. Each pair of left-hand guiding orifices 219*a* are arranged respectively in a third and a fourth transversal plane, with the latter being offset in relation to said first and second transversal planes by a value different from the pitch of the right-hand 61, left-hand 62 helixes. Each right-hand 218*a* and left-hand 219*a* guiding orifice passes through the wall of the drum 211. The right-hand guiding orifices 218*a* and the left-hand guiding orifices 219*a* are similar to the right-hand 118*a, b* and left-hand 119*a, b* guiding orifices described hereinabove, and are arranged in such a way that, in the particular position of inversion of the movement transformation direction, each one of the right-hand guiding orifices 218*a* is across from the right-hand helix 61 and each one of the left-hand guiding orifices 219*a* is across from the left-hand helix 62. The right-hand 218*a* and left-hand 219*a* guiding orifices are moreover offset distally and angularly in the transversal plane in relation to said connecting orifices 216 in such a way that, in the particular position, when the connecting orifices 216 are across from an intersection of the right-hand 61 and left-hand 62 helixes of the pin 6, the right-hand 218*a* and left-hand 219*a* guiding orifices are not across from such an intersection.

As described hereinabove, each one of the right-hand 218*a* and left-hand 219*a* guiding orifices respectively receives a right-hand guiding ball 228*a* and a left-hand guiding ball 229*a* defining respectively the right-hand and left-hand guiding elements. These right-hand 228*a* and left-hand 229*a* guiding balls are similar to the right-hand 118*a* and left-hand 119*a* guiding balls described hereinabove and have in particular the same characteristics in terms of dimensions, mobility and positioning.

Likewise, the casing 207 comprises two pairs of right-hand guiding housings and two pairs of left-hand guiding housings (not shown in the figures) each one able to respectively receive the portion of the right-hand 228*a* and left-hand 229*a* guiding ball that extends from the right-hand 218*a*, left-hand 219*a* guiding orifice when it is in its free position.

This embodiment is particularly advantageous, because the fact that the drum 211 comprises two pairs of right-hand guiding orifices 218*a* and two pairs of left-hand guiding orifices 219*a* associated with a right-hand 228*a* or left-hand 229*a* guiding ball further reinforces the robustness of the transformation device 300 and also makes it possible to improve the gentleness of the movement and to guide the pin 6 better during its movement of rotation. Indeed, it is understood that with two pairs of right-hand 218*a* or left-hand 219*a* guiding orifices, there is still at least one right-hand 228*a* or left-hand 229*a* guiding ball outside of an intersection of the right-hand 61 and left-hand 62 helixes of the pin 6. This configuration makes it possible to prevent any anchoring effect on the back-and-forth movement of the pin 6.

POSSIBILITIES FOR INDUSTRIAL APPLICATION

The reversible locking-wire pliers according to the invention comprising a movement transformation device can be used to seal certain pieces of equipment after they have been verified and/or adjusted and as such bear witness to the integrity of the equipment and of its adjustment. However, these locking-wire pliers can also be used to maintain elements in position in relation to one another.

It is understood that the examples described are only particular illustrations and in no way limit the invention and its fields of application. Those skilled in the art can make modifications to the size, shape, arrangement and materials to the examples of particular embodiments without however leaving the scope of this invention.

The invention claimed is:

1. Reversible locking-wire pliers comprising:

a pinching device having two clamping jaws, each of the two clamping jaws extending to form a handle, wherein the two clamping jaws are movable between an open position and a closed position;

a reversible movement controlling device comprising at least one casing and a pin having a longitudinal axis of revolution C and being movable with respect to the pinching device, wherein the pinching device is coupled to the reversible movement controlling device, and movement of the pin with respect to the pinching device is facilitated by the reversible movement controlling device during rotation of the pinching device, and wherein the pin comprises at least one recessed right-hand helix and at least one recessed left-hand helix having similar pitches, a coupling of the at least one casing and the pin comprising at least one right-hand guiding element and at least one left-hand guiding element, wherein the at least one casing is rotatable with respect to the pin between at least one drive position, wherein the at least one casing is forcefully coupled to one of the at least one recessed right-hand helix or the at least one recessed left-hand helix, and at least one free position, wherein the at least one casing is free with respect to the at least one recessed right-hand helix and the at least one recessed left-hand helix, and wherein the at least one casing is movable with respect to the at least one right-hand guiding element and at least one left-hand guiding element, such that the direction of rotation is reversible between:

a right-hand position wherein the at least one right-hand guiding element is in a drive position and the at least one left-hand guiding element is in a free position, and a left-hand position wherein the at least one right-hand guiding element is in the free position and the at least one left-hand guiding element is in the drive position;

the pliers further comprising a single drum, concentric with the pin, wherein the drum is arranged between the at least one casing and the pin, and wherein the drum comprises at least one guiding orifice configured to receive at least one first portion of the at least one right-hand guiding element or at least one left-hand guiding element, wherein at least one of the at least one right-hand guiding element or at least one left-hand guiding element is movable in the at least one guiding orifice such that a second portion of each of the at least one right-hand or at least one left-hand guiding elements is engaged in the at least one recessed right-hand helix or the at least one recessed left-hand helix when in the drive position of either the at least one right-hand guiding element or at least one left-hand guiding element, respectively.

2. The reversible locking-wire pliers according to claim 1, further comprising a device for recovering scraps comprises, a bit arranged on each one of the two clamping jaws and a sharp edge disposed on each of the two clamping jaws, said two bits being arranged facing at a right angle to the two sharp edges, and wherein the two bits are able to be displaced away from a cutting plane P of said sharp portions and a means of pressure associated with said bits, wherein the bits are configured to exert a force to maintain the two bits in contact with one another when the clamping jaws are in closed position.

3. The reversible locking-wire pliers according to claim 1, further comprising a device for recovering scraps comprises two deformable bits, wherein one deformable bit is integral with each of the two clamping jaws, said two deformable bits being configured to be deformed in such a way as to exert a force that tends to maintain the two deformable bits in contact with one another when the clamping jaws are in closed position.

4. The reversible locking-wire pliers according to claim 1, wherein the at least one right-hand and at least one left-hand guiding elements are angularly fixed with respect to the longitudinal axis C of the pin.

5. The reversible locking-wire pliers according to claim 1, wherein the at least one casing comprises at least one guiding housing and a bearing surface, wherein the at least one guiding housing is configured to align with the at least one right-hand or at least one left-hand guiding element when the at least one right-hand or at least one left-hand guiding element is in the free position and is configured to receive a third portion of the at least one right-hand or at least one left-hand guiding element, and wherein the bearing surface is simultaneously configured to align with the at least one left-hand or at least one right-hand guiding element in the drive position and is configured to maintain engagement of a second portion of the at least one left-hand or at least one right-hand guiding element in the at least one recessed left-hand helix or the at least one recessed right-hand helix, respectively.

6. The reversible locking-wire pliers according to claim 5, wherein the at least one guiding housing is configured to receive the third portion of the at least one right-hand or at least one left-hand guiding element, when in a free position, without any portion of the at least one right-hand or at least one left-hand guiding element being engaged in a corresponding at least one recessed right-hand or at least one recessed left-hand helix, and wherein the at least one recessed right-hand or at least one recessed left-hand helixes are configured to receive the second portion of the at least one right-hand or at least one left-hand guiding element when in the drive position without any portion of the at least one right-hand or at least one left-hand guiding element when engaged in the at least one guiding housing, such that the at least one right-hand and at least one left-hand guiding elements can only exceed into one end of the at least one guiding housing when in the drive position or free position.

7. The reversible locking-wire pliers according to claim 5, wherein the height of the at least one right-hand and at least one left-hand guiding elements is greater than the thickness of a wall of the drum on the at least one guiding housing, such that the at least one right-hand and at least one left-hand guiding elements exceed at least one end of the at least one guiding housing.

8. The reversible locking-wire pliers according to claim 5, wherein the coupling is arranged such that in a right-hand position:

the at least one guiding housing is not in alignment with the at least one right-hand guiding element, the bearing surface is in alignment with the at least one right-hand guiding element, the at least one guiding housing is in alignment with the at least one left-hand guiding element, and the bearing surface is not in alignment with the displacement of the at least one left-hand guiding element; and such that in a left-hand position:

the at least one guiding housing is in alignment with the at least one right-hand guiding element, the bearing surface is not in alignment with the displacement of the at least one right-hand guiding element, the at least one guiding housing is not in alignment with the at least one left-hand guiding element, and the bearing surface is in alignment with the at least one left-hand guiding element.

9. The reversible locking-wire pliers according to claim 5, wherein the at least one casing is formed from sheet metal and wherein the at least one casing comprises at least one bowl-shaped deformation projecting outward and defining the at least one guiding housing, and wherein an inside surface of the at least one bowl-shaped deformation is the bearing surface.

10. The reversible locking-wire pliers according to claim 5, wherein the at least one right-hand guiding element and the at least one left-hand guiding element are configured to allow only angular mobility in a transversal plane of the at least one casing with respect to the drum between the right-hand and left-hand position, wherein at least one right-hand guiding orifice, a right-hand bearing surface and at least one right-hand guiding housing are arranged in a single right-hand cone of revolution, and wherein at least one left-hand guiding orifice, a left-hand bearing surface and at least one left-hand guiding housing are arranged in a single left-hand cone of revolution, wherein at least two first abutments, a second abutment, and a blocking orifice are arranged in a single abutment cone of revolution, and wherein the at least two first abutments are offset angularly on the single abutment cone of revolution.

11. The reversible locking-wire pliers according to claim 10, wherein the right-hand cone of revolution is offset longitudinally from the left-hand cone of revolution.

12. The reversible locking-wire pliers according to claim 10, wherein at least one of the single left-hand cone of revolution and the single right-hand cone of revolution forms an angle of 180 degrees and defines a transversal plane, wherein at least one of the at least one right-hand guiding orifice, at least one left-hand guiding orifice, a connecting orifice, and a blocking orifice is substantially perpendicular to the longitudinal axis of the pin, and wherein the at least one right-hand guiding element, the at least one left-hand guiding element, a connecting element, and a corresponding blocking element are fixed longitudinally in relation to the pin.

13. The reversible locking-wire pliers according to claim 1, wherein the drum comprises at least one connecting element configured to engage in one of the at least one recessed right-hand or at least one recessed left-hand helixes, according to the at least one connecting element's alignment.

14. The reversible locking-wire pliers according to claim 13, wherein the at least one connecting element is offset angularly in a transversal plane or longitudinally with respect to the at least one guiding orifice, such that when the at least one connecting element is at a first intersection of the at least one recessed right-hand helix and the at least one recessed left-hand helix, none of the at least one right-hand or at least one left-hand guiding elements are located at a second intersection of the at least one recessed right-hand and at least one recessed left-hand helixes.

15. The reversible locking-wire pliers according to claim 14, wherein the drum comprises a radial connecting orifice opening toward an inside of the drum, wherein the radial connecting orifice is closed off toward an outside of the drum and is configured to receive the at least one connecting element.

16. The reversible locking-wire pliers according to claim 13, wherein the drum comprises a radial connecting orifice opening toward the inside of the drum and closed off to the outside of the drum, wherein the radial connecting orifice is configured to receive the at least one connecting element.

17. The reversible locking-wire pliers according to claim 16, wherein the radial connecting orifice passes through the drum and the at least one casing is provided with a continuous connecting surface across from and closing off the radial connecting orifice.

18. The reversible locking-wire pliers according to claim 1, wherein a blocking element is configured to lock the at least one casing and drum in at least one of the right-hand and left-hand positions.

19. The reversible locking-wire pliers according to claim 18, wherein the blocking element comprises at least two first abutments provided on one of the drum or casing, wherein the at least two first abutments are offset between the drum and casing angularly or longitudinally, and a second abutment coupled to the at least one casing or drum, wherein the second abutment cooperates with one of the at least two first abutments so that the second abutment is urged toward the drum or casing by an elastic return, wherein passage between the right-hand position and left-hand position requires application of a force greater than that exerted by the elastic return.

20. The reversible locking-wire pliers according to claim 19, wherein the drum and casing comprise two blocking housings oriented toward the at least one casing and drum, respectively; the two blocking housings defining the at least two first abutments; the at least one casing and the drum comprising a blocking orifice housing a blocking element defining the second abutment and a blocking spring defining an elastic return element, wherein the blocking element is urged radially toward the drum and the at least one casing, respectively, and a portion of the blocking element is housed in one of the two blocking housings in each one of a right-hand and left-hand position.

21. The reversible locking-wire pliers according to claim 1, wherein the coupling comprises a guide that only allows one of angular mobility in a transversal plane or longitudinal mobility of the at least one casing and of the drum between a right-hand and left-hand position.

22. The reversible locking-wire pliers according to claim 1, wherein the drum comprises at least one right-hand guiding orifice configured to receive at least one portion of the at least one right-hand guiding element and at least one left-hand guiding orifice configured to receive at least one portion of the at least one left-hand guiding element.

23. The reversible locking-wire pliers according to claim 1, wherein the at least one casing comprises at least one right-hand guiding housing configured to receive a third portion of the at least one right-hand guiding element when in the drive position, at least one left-hand guiding housing configured to receive a third portion of the at least one left-hand guiding element when in the drive position, and a right-hand bearing surface configured to maintain the at least one right-hand guiding element in the drive position and a left-hand bearing surface configured to maintain the at least one left-hand guiding element in the drive position.

24. The reversible locking-wire pliers according to claim 1, wherein the at least one casing comprises at least two half-shells assembled together around the drum and secured by a fastener.

25. The reversible locking-wire pliers according to claim 24, wherein the drum comprises two lateral portions separated by a median portion having a reduced outer diameter with respect to an outer diameter of the two lateral portions, wherein the drum is configured to receive the half-shells of the at least one casing, and wherein a difference in diameter between the median portion and the two lateral portions defines an angular guiding element.

26. The reversible locking-wire pliers according to claim 24, wherein the coupling comprises at least one pair of right-hand guiding housings, each provided with the at least one right-hand guiding element; a pair of left-hand guiding housings, each provided with the at least one left-hand guiding element; a pair of right-hand bearing surfaces; and a pair of left-hand support surfaces.

27. The reversible locking-wire pliers according to claim 1, wherein at least one of the at least one right-hand guiding elements, the at least one left-hand guiding elements, a connecting element, and a blocking element further comprises a ball.

28. The reversible locking-wire pliers according to claim 1, wherein the drum and the at least one casing are arranged to define at least one portion of a cylinder of revolution.

29. The reversible locking-wire pliers according to claim 1, wherein the at least one casing comprises an anchor configured to cooperate with at least one anchoring element external to the reversible movement controlling device in order to prevent rotation of the at least one casing with respect to the external anchoring element.

30. The reversible locking-wire pliers according to claim 1, wherein the reversible locking-wire pliers comprise a locking element configured to maintain the handles in a closed position when in a resting state to allow the handles to open when urged, wherein a portion of the locking element is combined with an anchoring element.

31. The reversible locking-wire pliers according to claim 1, further comprising a sharp portion on each of the clamping jaws, the sharp portions being configured to cut a wire, and a scrap retrieving element configured to receive scraps of wire.

* * * * *